United States Patent [19]

Elliott

[11] Patent Number: 4,782,539

[45] Date of Patent: Nov. 8, 1988

[54] RESCUE SEAT

[76] Inventor: Larry Elliott, P.O. Box 1052, Rosetown, Saskatchewan, Canada, S0L 2V0

[21] Appl. No.: 879,515

[22] Filed: Jun. 24, 1986

[30] Foreign Application Priority Data

Sep. 4, 1985 [CA] Canada ..... 489974

[51] Int. Cl.[4] ..... A61G 7/08; A61G 1/00

[52] U.S. Cl. ..... 5/81 R; 5/82 R; 5/89; 224/159; 294/140

[58] Field of Search ..... 5/82 B, 82 R, 81 R, 5/89; 294/140, 149, 150, 151, 152; 224/158–161

[56] References Cited

U.S. PATENT DOCUMENTS

| | | | |
|---|---|---|---|
| 722,456 | 3/1903 | Reeves | 5/82 R |
| 954,840 | 4/1910 | Wiedemann | 5/82 R X |
| 1,035,642 | 8/1912 | Rosse | 5/89 X |
| 1,849,864 | 3/1932 | Caspar | 5/82 |
| 2,015,391 | 9/1935 | Anderson | 5/82 |
| 2,044,717 | 6/1936 | McElmeyl | 5/432 X |
| 2,273,672 | 2/1942 | Van Gasselt | 5/82 R |
| 2,350,573 | 6/1944 | Smith, Jr. et al. | 5/82 R |
| 2,735,716 | 2/1956 | Shimabukuro | 5/416 X |
| 2,835,902 | 5/1958 | Fash | 5/82 R |
| 3,271,796 | 9/1966 | Dillman | 5/82 R |
| 3,829,914 | 8/1974 | Treat | 5/82 R X |
| 3,859,677 | 1/1975 | Nordwig | 5/89 |
| 4,283,068 | 8/1981 | Keyser | 5/82 R X |
| 4,338,691 | 7/1982 | Gaffney | 5/82 R X |
| 4,478,452 | 10/1984 | Clemens | 5/82 R X |

FOREIGN PATENT DOCUMENTS

| | | | |
|---|---|---|---|
| 341138 | 5/1939 | France | 5/417 |
| 1414479 | 9/1965 | France | 5/82 R |
| 2271805 | 12/1975 | France | 5/82 R |
| 2672 | 11/1918 | Netherlands | 5/82 R |
| 77528 | 5/1954 | Netherlands | 5/82 R |
| 468336 | 7/1937 | United Kingdom | 5/82 R |

*Primary Examiner*—Richard E. Moore
*Assistant Examiner*—Michael F. Trettel
*Attorney, Agent, or Firm*—Bergman, Aisenberg & Platt

[57] ABSTRACT

There is provided a new and useful emergency rescue seat comprising a body section having bottom back, and side support panels; a first pair of lifting means located near the top corners of the said back support panel; and a second pair of lifting means located adjacent the forward corners of the bottom support panel.

2 Claims, 1 Drawing Sheet

RESCUE SEAT

This application relates to an apparatus for the emergency transport of incapacitated persons.

BACKGROUND OF THE INVENTION

It is presently the case that the equipment available to emergency response teams, such as ambulance attendants, is not adequate to deal with certain types of emergency situations that arise on a frequent basis. In particular, in those situations where it is necessary to move bedridden or otherwise incapacitated persons up or down stairs, there is currently no adequate equipment available. Such a need arises at hospitals, hotels, apartment buildings and single-family dwellings.

The current solution to this problem is to use ordinary kitchen or dining room chairs or armchairs or the like or in some cases to use spine boards.

This is clearly an unacceptable situation. A wide variety of problems can arise in attempting to make use of available material. For example, an acceptable chair type may not be available. Again, it is very difficult to restrain in such a chair a person who is unconscious or semiconscious. Delays occasioned by strapping patients into chairs and the like is very time consuming in situations where time may be critical.

Further problems arise from the awkward sizes and shapes of available chairs and, as well, of spine boards, particularly in terms of manoeuvrability around corners, doorways and like.

Finally, a safety problem arises with the use of available chairs because emergency response teams can never be confident of the strength of chairs found at the scene.

It is therefore evident that a serious need exists for a satisfactory means of transporting patients up or down stairs to the waiting ambulance.

The present invention is directed toward a rescue seat designed to alleviate the problems discussed above.

PRIOR ART

The applicant is not aware of any particular prior art patents which are relevant to the presence case. Various types of non-rigid stretchers have been developed and utilized in the past, but none have anything in common with the present case.

Examples of such cases include U.S. Pat. Nos. 2,788,530, granted Apr. 16, 1957 to Ferguson; and 2,273,672, granted Feb. 17, 1972, to Van Gasselt.

BRIEF SUMMARY OF THE INVENTION

The applicant has developed a non-rigid carrying device having something of a scoop shape in which an incapacitated person or body can be transported. Handles are provided for use by two emergency response personnel.

Thus, the invention provides an emergency rescue seat comprising a body section having bottom, back, and side support panels; a first pair of lifting means located near the top corners of the said back support panels; and a second pair of lifting means located adjacent the forward corners of the bottom support panel.

BRIEF DESCRIPTION OF THE DRAWINGS

In drawings which illustrate embodiments of the invention.

DETAILED DESCRIPTION OF THE PREFERRED EMBODIMENTS

Figure 1:
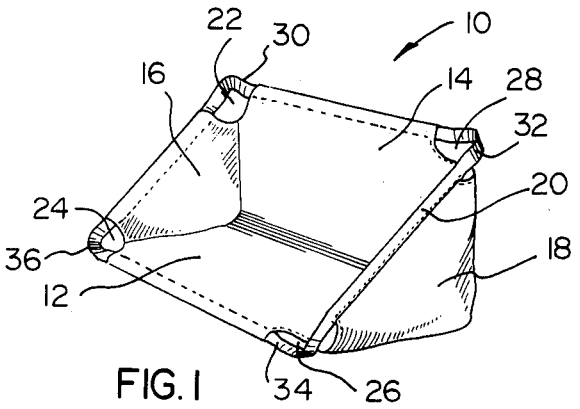
FIG. 1 is a perspective view of the rescue seat according to the invention.
Figure 2:
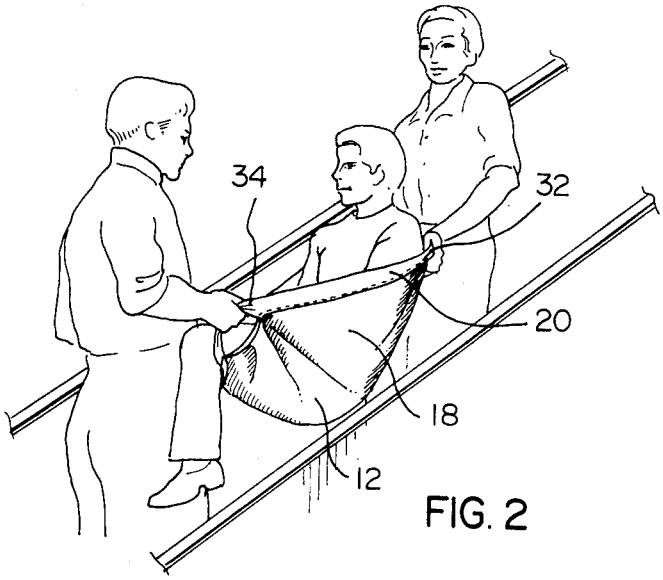
FIG. 2 illustrates one manner of use of a rescue seat of FIG. 1.

With reference to FIGS. 1 and 2, the generally scoop-shaped rescue seat 10 comprises a bottom support panel 12, a rear support panel 14 and side support panels 16 and 18. In the preferred case at least the bottom and rear panels 12 and 14 are integral. The panels are comprised of a flexible material of relatively high strength. For example certain vinyl based materials are suitable, such as that sold under the trade mark CENTEX.

Around the outer extremities of the body panels a reinforcing strapping material 20 is secured. For example, a woven nylon strapping of about one inch width and two-ply thickness is preferred. A preferred manner of fastening the strapping to the vinyl is by use of ten pound test nylon thread. Clearly, other materials and methods of securing will be readily apparent to those skilled in the art.

At each of the corner extremities of the rescue seat 10, portions of the panels are cut away as shown at 22, 24, 26 and 28. The cut away areas expose the strapping 20 at 30, 32, 34 and 36 to form carrying or support handles.

The manner of use of the rescue seat in moving an incapicatated person up or down stairs is illustrated in FIG. 2. As is evident, the flexible nature of the materials enables the rescue seat to essentially wrap around the major body portion of the patient so that it is unnecessary that he be strapped or otherwise restrained in the chair. As well, the chair is also effective where the patient is unconscious.

It is also apparent from FIG. 2 that the panels making up the rescue seat can be a single integral unit.

Figure 3:
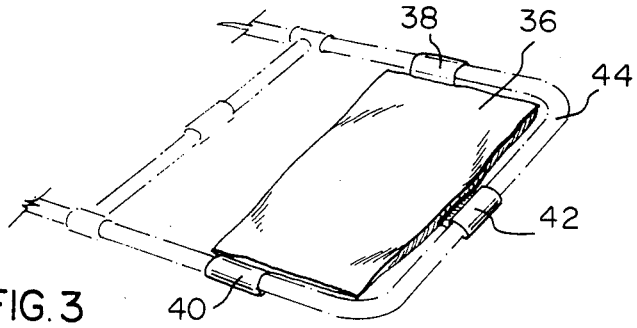
FIG. 3 illustrates a carry bag for attaching the rescue seat to the frame of a standard stretcher.

FIG. 3 illustrates a specific one of the advantages of the rescue seat. Emergency response vehicles are generally packed to capicity with various pieces of equipment. The design and storage of the necessary equipment in the space available is in itself a major area of concern. In the case of the present invention the seat can be folded and stowed in the folded condition in carrier bag 36 which is secured by straps 38, 40 and 42 to the frame 44 of a stretcher. The carrier 36 can thus be stored for very convenient use at the scene of an emergency while at the same time not taking up any of the valuable space in the emergency response vehicle. Furthermore, the fact that it is not necessary to strap the patient into the seat contributes significantly to the speed at which the emergency rescue can be effected.

It is clear from the above description that there has been provided a vastly improved rescue seat which serves to alleviate many of the problems encountered previously in the situations for which the seat is designed.

What I claim as my invention:

1. An emergency rescue seat comprising:

a flexible bottom support panel including first and second side edges and a rear edge;

a flexible back support panel including first and second side edges and a bottom edge and joined along said bottom edge to said rear edge of said bottom support panel;

two flexible triangular side support panels including first and second side edges and said first and second bottom edges and joined to respective ones of said first and second side edges of said bottom and back support panels, said edges of said triangular panels extending over a major portion of said edges of said bottom and back support panels;

and first and second pairs of lifting means located respectively adjacent the upper corners of said first back panel and the forward corners of said bottom panel; and wherein said panels are constructed of material having sufficiently flexibility that said seat is longitudinally and transversely flexible to partially enfold the patient being carried therein, said support panels including a reinforcing strip along their respective free edges, in which said strip is continuous around the free edge of said support panels, the outer corners of said support panels are truncated and the said continuous strip passes across said truncated areas whereby to form handles which comprise said lifting means, and in which the said strip is a woven webbed material.

2. The rescue seat of claim 1 wherein said edges of said triangular side supports are substantially equal in length to said edges of said back and bottom support panels to which they are joined.

* * * * *